United States Patent [19]

Poeschl

[11] 4,238,286

[45] Dec. 9, 1980

[54] DEWATERING TABLE BAR FOR THE WIRE CLOTH OR FELT IN A PULP-DEWATERING MACHINE

[76] Inventor: Rudolf Poeschl, A 1150 Vienna, Mariahilferstrasse 135, Austria

[21] Appl. No.: 41,366

[22] Filed: May 22, 1979

[51] Int. Cl.[3] ..... D21F 1/00

[52] U.S. Cl. ..... 162/352; 162/374

[58] Field of Search ..... 162/374, 352, 354

[56] References Cited

U.S. PATENT DOCUMENTS 3,446,702 5/1969 Buchanan ..... 162/374

3,953,284 4/1976 Evälahti ..... 162/374

FOREIGN PATENT DOCUMENTS 448291 6/1936 United Kingdom ..... 162/374

*Primary Examiner*—S. Leon Bashore

*Assistant Examiner*—Peter Chin

*Attorney, Agent, or Firm*—Millen & White

[57] ABSTRACT

A table bar over which the dewatering wire cloth of a paper making machine travels is formed of extruded steatite or the like whose leading edge is recessed to receive a ceramic oxide element which renders the table bar abrasion resistant.

10 Claims, 6 Drawing Figures

DEWATERING TABLE BAR FOR THE WIRE CLOTH OR FELT IN A PULP-DEWATERING MACHINE

This invention relates to a component for cooperating with a wire cloth or felt in a pulp-dewatering machine, particularly in a paper machine, especially to a table bar, which comprises hard elements, which are embedded in or bonded to a softer material, and which component extends preferably throughout the width of the pulp-dewatering machine, and to a process of manufacturing such component.

Most modern paper machines comprise wire cloths of plastic material. Such wire cloths travel at a much higher speed than the bronze wire cloths used in the past. Whereas bronze wire cloths suffered only a very slight wear when moved in contact with suction bars, table bars or the like made of high-molecular low-pressure polyethylene, plastic wire cloths particularly when used to process a filler-containing pulp are subjected to high friction and high wear in contact with polyethylene bars. For this reason it has already been proposed to incorporate steel inserts in the surface of polyethylene bars in order to reduce the wear caused by plastic wire cloth. Such steel inserts are unsatisfactory because they are highly susceptible to corrosion. For this reason it has subsequently been proposed to use ceramic oxides as a material for the surface of components which cooperate with the wire cloth or felt in a pulp-dewatering machine although such ceramic oxides are highly expensive and can be mounted and adjusted only as individual items and with substantial difficulty. Components of ceramic oxides are made in the form of relatively short segments of about 200 to 300 mm and have a hardness of about 9.2 on the Mohs scale. It is also required that for cleaning the bars of a paper machine can be pulled out of the paper machine during the operation of the wire cloth. For this reason it has already been proposed to fix ceramic oxide components to a steel bar by means of a polyester resin. The use of an extensible bar as a component which cooperates with the wire cloth of a pulp-dewatering machine involves several disadvantages. Ceramic oxides, epoxide resins and the bar of nickel-chromium steel differ greatly in thermal expansion so that small portions of the ceramic oxide segments may break off or spall off at the joints. The resulting small surface irregularities endanger the wire cloth, which moves over such bar at high speed, and may cut the wire cloth apart. Besides, table bars must have a sloping surface which cooperates with the wire cloth and extends from the sharp leading edge which initially contacts the wire cloth. Such sloping surface can be formed only by expensive grinding operations and, owing to their high Mohs hardness, ceramic oxides can be ground only with diamond grinding wheels.

It is an object of the present invention to provide a component which is of the kind described first hereinbefore and which can be made at lower cost and avoids the above-mentioned disadvantages and can be made simply in the desired shape. This object is accomplished according to the invention in that the softer material consists of steatite or special steatite. Hereinafter, the terms "steatite" and "special steatite" will be used to describe materials described in DIN 40 685, Sheet 1/VDE 0335, Part 1, on pages 10 to 17 as Types KER 220 and KER 221. The properties of the known ceramic oxide elements used in the surface of such components are substantially in accordance with the data for Group 700, particularly of Type KER 710, of the same DIN standard specification. The steatite or special steatite used in accordance with the invention distinguishes in that it is virtually non-swellable and compared to the known design, in which the ceramic oxide elements are joined to a steel bar by means of filler-containing epoxide resins, has the advantage that there will be no differential expansion. In the temperature range in question, between 20° and 100° C., ceramic oxides have a coefficient of linear expansion $a_t$ amounting to 5 to $7\times10^{-6}$° C.$^{-1}$. The apparent specific gravity of the material used according to the invention is at least 2.6 to 2.7 kg/dm$^3$. Steatite or special steatite has a crushing strength of at least 850 to 900 N/mm$^2$, a bending strength between 120 and 140 N/mm$^2$ and a hardness of about 7 on the Mohs scale. Whereas the previously employed epoxide resin, such as Araldit 404 of Ciba-Geigy, has a coefficient of expansion between 30 and $35\times10^{-6}$° C.$^{-1}$ and nickel-chromium steel has a coefficient of expansion of about $16\times10^{-6}$° C.$^{-1}$, the material used according to the invention has substantially the same coefficient of expansion as ceramic oxides so that a warping or spalling of the ceramic oxide elements at the joints need not be feared in the components according to the invention in case of temperature fluctuations. In that connection it must be taken into account that paper machines have a width of about 3 m to about 9 m so that, e.g. in machines having a width of 4 m a temperature change from 20° to 50° C. will result in a calculated change in length which in the case of said synthetic resin amounts to 3.84 mm, in the case of said ceramic oxide or special steatite amounts to about 0.72 mm, and in the case of steel amounts to 1.92 mm.

With the design according to the invention it is possible to cover the component with the expensive ceramic oxide segments only at its leading edge. To that end, the material consisting of steatite or special steatite preferably constitutes a part which has apertures or recesses for receiving the hard elements, which consist particularly of ceramic oxides, and these hard elements are provided only adjacent to the leading edge of the component. In that case the design may be such that the component slopes from the joint between the hard parts and the surface of the steatite or special steatite as far as to its trailing edge. The part of steatite or special steatite may be initially formed with said sloping surface or may subsequently be ground to form said sloping surface. Steatite or special steatite can be ground with silicon carbide without damage to the surface of the ceramic oxide elements because the hardness of steatite or special steatite is lower by two units of the Mohs scale than the hardness of ceramic oxides. The surface properties of steatite or special steatite are highly superior to those of synthetic resin. It has been found that the abrasive wear of such surfaces which consist of steatite or special steatite and cooperate with the wire cloth is much lower than the corresponding wear of plastics. Because the special steatite or steatite can be ground more easily than ceramic oxides, the surface which cooperates with the wire cloth or felt can be given any desired shape and may particularly have a concave curvature which conforms to the catenary formed by the wire cloth. In this way, the dewatering action of such bar can be greatly improved because no pulp can deposit and other phenomena which would adversely affect the formation of the sheet will not occur.

The ceramic products made of steatite or special steatite can also be made only in short lengths, as a rule. A particularly high stiffness will be achieved and the risk of a spalling of the ceramic oxide elements at the joints will be minimized if the segments consisting of steatite or special steatite are joined to the segments of hard material, particularly of ceramic oxide, in such a manner that in a top plan view at least those joints of the steatite or special steatite segments which succeed in the axial direction of the component are offset from the joints of the hard segments. This results in a bricklike bond, which increases the rigidity of the component. The ceramic oxide segments and the segments of steatite or special steatite can be joined simply and without appreciable additional difficulty by means of synthetic resin adhesives which are so elastic that the differential expansion can be compensated. Such component may be designed in a simple manner to have a body which consists of steatite or special steatite and which on the underside, remote from the wire cloth, has a groove which permits the component to be slidably fitted on a mating element of the underframe of the paper machine, particularly on a T-beam. Because the component has only a low tendency to warp under the influence of temperature differences, which may be due, inter alia, to the friction between the component and the wire cloth travelling at high speed in contact with the component, such groove ensures that the component can easily be pulled from the underframe and when it has been cleaned can just as easily be slidably fitted. When the known bars were to be removed from the underframe, it was usually necessary to strike on the end face of the bar. The resulting impact stress gave rise to a spalling of the ceramic oxide segments at the joints. Alternatively, the steatite or special steatite segments of the body may be combined on a common carrying bar, which is substantially channel-shaped and consists particularly of steel, to form a unit which extends throughout the width of the paper machine. In that case too there will be no appreciable thermal stress because the carrying bar is insulated from the delicate ceramic oxide segments by the body segments of steatite or special steatite.

The process according to the invention of manufacturing such component is essentially characterized in that steatite or special steatite is extruded to form an extruded piece which has apertures or recesses for receiving the hard segments and the hard segments are then fixed in the apertures or recesses by means of an adhesive, particularly a synthetic resin adhesive. Steatite or special steatite can be shaped with high dimensional accuracy by casting or extruding. Extrusion has the advantage that even relatively long components of steatite or special steatite can be made with high dimensional accuracy. In accordance with the invention the part of steatite or special steatite is extruded. This results in a homogeneous body, which can be ground, e.g., to have at its trailing edge an inclination of 0.5° to 4° or to form curved contacting surfaces conforming to the catenary formed by the wire cloth, and after such grinding will have the same surface hardness as before it was ground. Chilled castings are not so homogeneous because they usually have a harder surface and a slightly softer core so that the surface hardness will be reduced by grinding.

The part may be extruded in a simple manner to have apertures which extend axially through the part. If said apertures consist of bores extending in the axial direction of the component, tie rods and/or coolants may be introduced into such bores. The through aperture may alternatively be defined by a downwardly open sectional recess, which fits a mating section of the underframe of the paper machine.

The component according to the invention may be made in a simple manner in that the hard elements consisting particularly of ceramic oxides are placed on a plane surface and parts consisting of steatite or special steatite and having substantially the same segment length are placed on the hard segments so as to be staggered therefrom in their longitudinal direction and are joined to the hard segments under pressure and with a synthetic resin adhesive.

The invention will now be explained more fully with reference to embodiments shown by way of example on the drawings, in which FIG. 1 is a transverse sectional view showing a steatite part in accordance with the invention;

Figure 1:
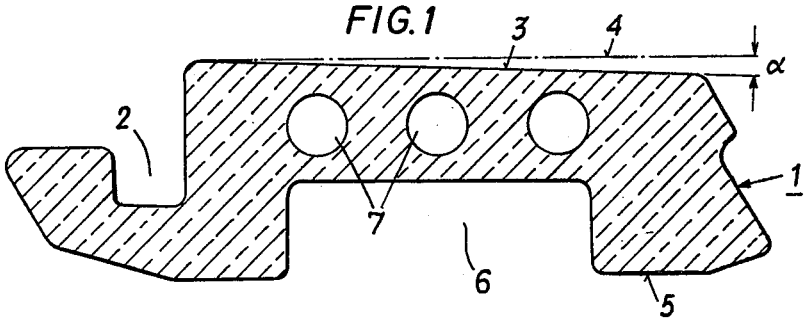

FIG. 1 shows an extruded body 1, which consists of steatite and has recesses 2 for receiving ceramic oxide segments. That surface of the part 1 which is contacted by the wire cloth is designated 3 and slopes toward its trailing edge at an angle $\alpha$ of about 3° from the plane 4, which is aligned with the ceramic oxide segments, not shown. When the ceramic oxide segments have been inserted into and bonded in the recess 2 by means of an adhesive, the surface 3 will be ground and polished. Opposite to its surface 3 in contact with the wire cloth, the part has a surface 5, which is formed with a recess 6, which can be fitted on a mating section, not shown, of the underframe of the paper machine. The part 1 is also formed with bores 7, which extend in its axial direction and through which tie rods can be inserted. Alternatively, a coolant may be passed through these bores.

Figure 2:
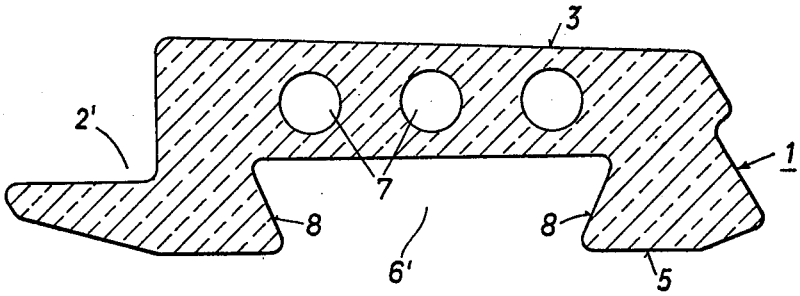
FIG. 2 is a transverse sectional view showing a modified part.

In FIG. 2, corresponding parts are designated with the same reference characters as in FIG. 1. The recess 2' adjacent to the leading edge of the component differs from the recess 2 shown in FIG. 1. The recess 6' on the surface 5 which is opposite to the surface 3 in contact with the wire cloth differs also from the recess 6 shown in FIG. 1. The recess 6' is defined by inclined side walls 8 so that a dovetail section is formed which can be slidably fitted on a mating section of the underframe of the paper machine.

Figure 3:
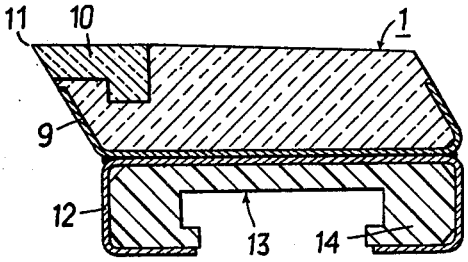
FIG. 3 is a transverse sectional view showing another embodiment with inserted segments of ceramic oxides.

In the embodiment shown in FIG. 3, a steatite body 1 is accommodated in a substantially channel-shaped carrying bar 9. The ceramic oxide elements 10 are disposed near the leading edge 11 of the component, which constitutes a table bar. In that arrangement the carrying bar 9 is adjoined by a section bar 12, which carries a channel 14, which may consist of plastic material and has a C-shaped recess 13, which fits a T-section of the underframe of the paper machine.

Figure 4:
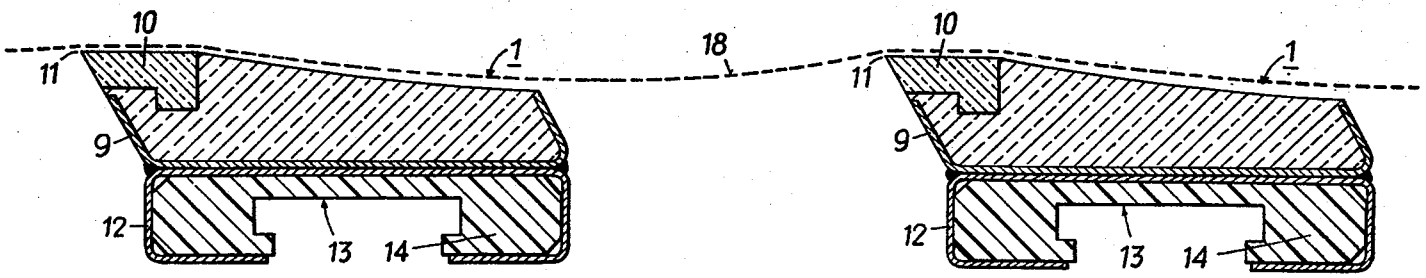
FIG. 4 shows a modification in a sectional view similar to that of FIG. 3.

FIG. 4 shows two components in a sectional view which is similar to that of FIG. 3. These components consist of table bars. The wire cloth is indicated at 18. In this Figure, the catenary formed by the wire cloth is exaggerated. The direction of travel of the wire cloth is indicated by the arrow 19. It is apparent that the travelling wire cloth initially contacts the leading edge 11 and then slopes down over the body of part 1. That surface of said body which cooperates with the wire cloth 18 is concavely curved. The radius of curvature is slightly smaller than would correspond to the catenary formed by the wire cloth 18. As a result, a wedge-shaped water layer can form between the wire cloth 18 and the surface of the body and will promote the dewatering of the pulp. In that case, the component does not slope at its trailing edge at an angle of up to 4°, as in the design shown in FIG. 3, but is ground to have a concave curvature in accordance with the catenary formed by the wire cloth inasmuch as this is required for dewatering.

Figure 5:
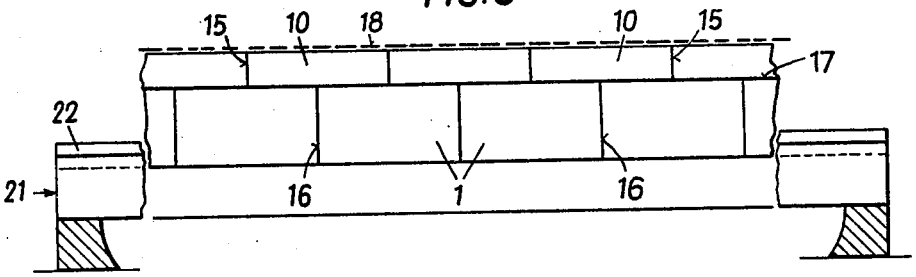
FIG. 5 is a fragmentary front elevation showing a portion of a component according to the invention, viewed opposite to the direction of travel of the wire cloth.

FIG. 5 shows a component according to the invention viewed in front elevation opposite to the direction of travel of the wire cloth. In that embodiment the joints 15 between the ceramic oxide segments 10 are disposed centrally between the joints 16 of the body segments 1 of steatite or special steatite and the segments 10 are bonded to the segments 1 by means of an adhesive layer 17. The underframe of the paper machine is designated 21 and comprises a T-beam 22, on which the dewatering bar can be slidably fitted from the side. The wire cloth is again designated 18.

Figure 6:
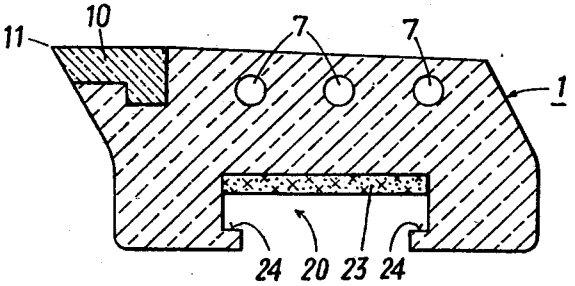
FIG. 6 shows another embodiment of the component according to the invention in a sectional view which is similar to that of FIG. 3.

FIG. 6 is a transverse sectional view which is similar to that of FIG. 3 and shows a component according to another embodiment of the invention. The body 1 made of steatite or special steatite is formed on its underside with a profiled groove, which can be fitted on a T-beam of the underframe of the paper machine. The ceramic oxide elememts are again designated 10. Tie rods and/or coolants can be passed through the bores 7, which extend in the longitudinal direction of the component. Because in accordance with the invention the body consists of an extruded piece of steatite or special steatite, the sectional groove 20 can be made much larger than is possible in the known components formed with such grooves for mounting the bar. In the embodiment shown in FIG. 6, that groove contains an interlayer 23, which consists of felt and facilitates the fitting of the bar on the T-beam of the underframe. Because the groove may be made almost in any size which is desired, the interlayer 23 may be replaced in the component according to the invention, e.g., by a flexible tube, which can be inflated by a hydraulic or pneumatic fluid. As such flexible tube is inflated, the bar is raised until inwardly protruding flanges 24 engage the T-beam of the underframe from below. In this way the elevation of the bar can be exactly controlled. This advantage is also afforded only by the use of a body 1 consisting of extruded pieces because this will permit of a provision of grooves having any desired shape.

The components according to the invention may be provided in the form of table bars, as shown on the drawing, or in the form of dewatering bars for suction boxes. In the latter case, the surfaces of the parts of steatite or special steatite are coplanar with the surface of the ceramic oxide inserts.

What I claim is:

1. In a dewatering table bar for the moving wire cloth or felt of a paper making or like pulp dewatering machine, the table bar comprising means for stationary mounting thereof on such machine transversely to the direction of motion of the wire cloth or felt, and having a surface in sliding contact with the underside thereof, including a leading edge and a trailing edge, the leading edge being formed of a harder wear resistant element embedded in a softer less wear resistant body member, the improvement wherein the softer member is formed of a steatite material having substantially the same coefficient of expansion as the harder element.

2. A table bar according to claim 1, wherein the harder element is an insert member fitted into an aperature or recess of the softer body member and the softer member forms the remainder of the sliding surface of the table bar.

3. A table bar according to claim 2, wherein the harder element is formed from a ceramic oxide.

4. A table bar according to claim 1, wherein the surface thereof in sliding contact with the wire cloth or felt slopes downwardly from the leading edge to the trailing edge thereof.

5. A table bar according to claim 4, wherein the sloping surface is curved so as to conform with the catenary formed by the wire cloth or felt.

6. A table bar according to claim 2 wherein the harder element and the softer body member each are segmented, the segments of the harder element are joined together end to end and the segments of the softer body member also are joined together end to end, the segments being joined together in the longitudinal direction of the table bar with the joints joining adjacent segments of the softer body member being offset longitudinally from the joints joining adjacent segments of the harder element.

7. A table bar according to claim 1 wherein the means for mounting thereof on such machine comprises a groove means in the side thereof opposite the side in sliding contact with the wire cloth or felt, for mounting the table bar on a mating section of the underframe of a paper making machine.

8. A table bar according to claim 6 wherein the segments of the softer body member have at least one channel extending longitudinally therethrough, through which a bar extends to form a unit of a length sufficient to extend the width of a paper making machine.

9. A table bar according to claim 3 wherein the surface thereof in sliding contact with the wire cloth or felt slopes downwardly from the leading edge to the trailing edge thereof and is curved so as to conform with the catenary formed by the wire cloth or felt, wherein the harder element and the softer body member each are segmented, the segments of the harder element are joined together end to end and the segments of the softer body member also are joined together end to end, the segments being joined together in the longitudinal direction of the table bar with the joints joining adjacent segments of the softer body member being offset longitudinally from the joints joining adjacent segments of the harder element.

10. A table bar according to claim 9 wherein the harder element is an insert member fitted into an aperature or recess of the softer body member and the softer body member forms the remainder of the sliding surface of the table bar and wherein the means for mounting thereof on such machine comprises a groove means in the side thereof opposite the side in sliding contact with the wire cloth or felt, for mounting the table bar on a mating section of the underframe of a paper making machine.

* * * * *